United States Patent [19]

Aldecoa et al.

[11] 3,941,071

[45] Mar. 2, 1976

[54] SHIFTING TWEEN DECK STRUCTURE FOR CARGO VESSELS

[75] Inventors: Ramon Zubiaga Aldecoa, Las Arenas-Guecho; Arturo Aldecoa Lacombe, Bilbao; Jose Maria Zubiaga Carles; Javier Arostegui Salaverri, both of Las Arenas-Guecho; Damaso Urruticoechea Borde, Bilbao, all of Spain

[73] Assignee: Ascargo, S.A., Bilbao, Spain

[22] Filed: May 24, 1974

[21] Appl. No.: 472,949

Related U.S. Application Data

[63] Continuation-in-part of Ser. No. 280,554, Aug. 14, 1972, abandoned.

[30] Foreign Application Priority Data

Feb. 2, 1972 Spain ..... 399411

[52] U.S. Cl. ..... 114/72; 114/73

[51] Int. Cl.[2] ..... B63B 25/18

[58] Field of Search ..... 114/72, 73, 76, 85; 214/15 R, 12

[56] References Cited

UNITED STATES PATENTS

| | | | |
|---|---|---|---|
| 929,139 | 7/1909 | Kirchner | 114/73 |
| 2,242,635 | 5/1941 | Whittelsey | 214/15 R |
| 2,564,966 | 8/1951 | Farrell | 114/72 |
| 3,019,757 | 2/1962 | Bailey | 114/72 |
| 3,086,489 | 4/1963 | Lehmann | 114/72 |
| 3,291,324 | 12/1966 | Fulcher et al. | 114/72 |
| 3,387,581 | 6/1968 | Suganuma | 114/72 |
| 3,410,242 | 11/1968 | Kloess et al. | 114/72 |

*Primary Examiner*—Trygve M. Blix
*Assistant Examiner*—Gregory W. O'Connor
*Attorney, Agent, or Firm*—Dean Sandford

[57] ABSTRACT

A shifting tween deck structure for the holds of cargo vessels including a plurality of parallel beams movably supported between pairs of rails adjustably secured at the sides of the cargo hold. The beams span the hold and are individually movable on the rails to a central position below a cargo hatch to receive omnipallets of cargo which are supported in the hold between two adjacent beams. At least some of the omnipallets are movable on the beams, and the loaded pairs of beams are shiftable to the side of the hold. The unloaded beams are optionally shiftable to the sides of the cargo hold to convert the hold for dry bulk cargo or the beams can be removed and stowed on deck.

14 Claims, 10 Drawing Figures

SHIFTING TWEEN DECK STRUCTURE FOR CARGO VESSELS

This application is a continuation-in-part of application Ser. No. 280,554, filed Aug. 14, 1972 now abandoned.

This invention relates to cargo vessels, and more particularly to cargo vessels having holds which are utilizable both for dry bulk cargoes and general cargoes.

The holds of cargo vessels have been designed to haul either bulk cargoes when the hold is free from obstructions, or for general cargoes in holds provided with tween decks to support multiple tiers of cargo, such as palletized cargo or containers of cargo. Also, some vessels have been adapted for mixed cargoes by providing a conventional tween decks in the upper portion of the hold with the lower portion being left unobstructed for the hauling of dry bulk cargo. However, need exists for a cargo vessel that can be rapidly converted from the handling of dry bulk cargo to the handling of general cargo by the use of mechanisms contained aboard the vessel. When converted for the hauling of dry bulk cargo, it is desirable that the hold be substantially free of structural supports and other obstructions. Also, it is desirable that the tween deck structure utilized for the storage of general cargo be adjustable so that the height between the tween deck structures can be changed to accommodate various types and sizes of cargo and cargo containers, and that this structure be able to accommodate pallets of the maximum size and weight that can be loaded outside of the vessel and then placed aboard so as to provide high cargo handling efficiency.

Accordingly, a principal object of this invention is to provide a cargo vessel having cargo holds optionally convertible for the handling of dry bulk cargo or general cargo.

Another object of this invention is to provide a cargo handling system for cargo vessels that provides high handling efficiency for general cargo and that can be readily converted to provide an unobstructed hold for the transport of dry bulk cargo.

Still another object of this invention is to provide a tween decks structure for a ship's hold that is adapted for the storage of general cargo of various types and sizes, and which is readily manipulated to convert the cargo hold for the transport of dry bulk cargo.

A further object of the invention is to provide a cargo handling system for a cargo vessel that permits efficient handling of general cargo on omnipallets of maximum size and weight, and that is readily converted for the transport of dry bulk cargo.

A yet further object of the invention is to provide a cargo handling mechanism for the efficient handling of general cargo on omnipallets of maximum size and weight and that can be readily converted to provide a substantially unobstructed hold for the transport of dry bulk cargo, and in which all of the component parts of the mechanism are contained aboard the vessel.

Other objects and advantages of the invention will be apparent from the following description.

Briefly, this invention contemplates a shifting tween deck structure for the hold of a cargo vessel that includes a plurality of parallel beams movably supported between pairs of rails adjustably secured at the sides of the cargo hold. The beams span the hold and are individually movable on the rails to a central position below a cargo hatch to receive omnipallets of cargo which are supported in the hold between adjacent beams. At least some of the omnipallets are movable on the beams, and the loaded pairs of beams are shiftable to the side of the hold. The unloaded beams are optionally shiftable to the sides of the cargo hold to convert the hold for dry bulk cargo, or the beams can be removed and stowed on deck.

The two rails comprising each pair of rails are located at the same vertical level at opposite sides of the hold. The rails can be located at the sides of the hold or at the transverse bulkheads.

New vessels can be designed with holds with a vertical framework (frames, web-frames and bulkhead stiffeners) to which the rails are attached to support or vertically slide the tween decks. Vessels already in service are provided with horizontal rails attached to the hold framework at either the sides or bulkheads. The system can be incorporated into ship's longitudinal framing, at convenient vertical spacing, or vertical slide rails, or supports fixed on each longitudinal frame can be provided to adjust the vertical spacing between the horizontal rails.

The tween decks are formed by beams or girders having wheels or rollers and, therefore, being ready to roll or slide on the horizontal rails. Preferably, the wheels operate between an upper and a lower rail which avoids the possibility of derailing in heavy seas, or on one rail with a device to prevent derailing.

Where the rails are located adjacent to the transverse bulkheads and extend transversely of the vessel, the beams extend longitudinally of the vessel and move from side to side, i.e., to port or starboard. Where the pairs of rails are placed longitudinally of the vessel, the beams extend across the beam of the vessel and are shifted in a direction lengthwise of the vessel.

The beams are vertically spaced to permit rows of boxes, bales, cars, pallets, containers, or goods between each two tween decks. These vertical spacings can be arranged to suit the cargo either by sliding and fixing the rails at the desired locations, or by bolting the rails at the desired locations.

The beams form an open rack tween deck structure which supports a plurality of large pallets called "omnipallets." Each of the omnipallets independently supports its own cargo load, which can consist of one or several small pallets, or one or several containers. Each omnipallet consists of a frame adapted to support the cargo, and is provided with at least four wheels or rollers, two being located on each side, and also with fittings for cleats to secure the cargo and with four lift rings which allow the omnipallet to be lifted by a crane or cargo winch. The size of the omnipallets is limited by the size of the hatch opening and the maximum weight the cargo handling machinery can lift. This makes the omnipallets stowable at high speed.

If the cargo is known, each tween deck is vertically spaced according to the height of the cargo.

The horizontal separation between two adjacent beams which support the omnipallets and form the tween deck structure is achieved by shifting the beams on the rails by means of any mechanical, hydraulic, or pneumatic mechanism, such as rod or link mechanisms or telescopic cylinders. These beams may also be placed in their cargo position with the separation being maintained by cables.

When the hold is to be converted for the transportation of bulk cargoes, then using any one of these mechanisms, the beams are moved to the sides of the ship, or the bulkheads, as the case may be, and stowed side by side. Optionally, the beams can also be hung under the upper deck, thus leaving the hold unobstructed. This latter system of stowage is used when the beams are vertically adjustable and can be raised to the top of the hold, or can be bolted at different heights.

The system operates at maximum efficiency when each lift has the maximum volume for the hatchway or the maximum weight for the cranes. The omnipallets are placed on the quay and loaded with boxes, bales, cars, or other cargo, which is duly lashed or cleated into place. A pair of the beams are provided with the proper separation and shifted under the hatch. The omnipallets are placed upon the beams and shifted to the proper location. When a pair of beams is loaded with the maximum number of omnipallets, the next pair of beams are shifted into place and loaded. The various tiers are loaded from the bottom up, unless an opening is left to move more omnipallets vertically in the hold.

The first cargo of omnipallets received is stowed on the bottom tank top, and cleated down. The lowest tween deck beams are then uncleated and rolled on the side tracks until they are adequately spaced to receive the omnipallets. The first pallets with their cargo are secured to them, and loading is carried out covering the space between an end beam and a central beam. The loaded beams are shifted into the storage position. Next, the same operation is carried out in the space formed by the other end beam and the second central beam. This second pair of loaded beams is then shifted into the storage position. Lastly, the space between the central beams is loaded with more omnipallets. As each omnipallet is placed on the tween deck, it should be fixed or cleated into position. The same process is followed to load the rest of the tween decks. Preferably sufficient omnipallets are loaded onto the beams to completely cover each tier.

The transport of mixed cargo is also possible. For instance, containers and general cargo can be transported in the lower part of the hold and cars on the higher tween decks. Also, dry bulk cargo can be transported in the lower part of the hold and general cargo in the upper tween decks.

When the hold is unloaded of a general cargo and is prepared for a bulk cargo, the tween deck beams are rolled to each side of the hold, or to the end bulkheads, or they may be removed for storage on the upper weather deck, so as to stow the beams in a location where they do not obstruct the hold. For instance, in the case of light grain cargoes, it is not necessary that the beams be stowed apart. However, the omnipallets are first removed from the hold and stowed on the upper weather deck.

It can be clearly appreciated that the main features of this loading system are: (1) the use of omnipallets for a maximum cargo lift taking into consideration the dimensions of the hatch opening; (2) that the tween decks are comprised of an open structure; (3) that the tween decks structure shifts sideways or endwise so as to leave the hold substantially unobstructed; (4) that at least some of the omnipallets can be shifted on the tween decks; and (5) that the omnipallets can be stowed on top of each other on the upper deck, in the same manner in which the pontoon-type hatch covers are stowed when the ship is in port.

The tween deck structure of this invention and its method of operation will be more readily understood by reference to the following description and the accompanying drawings, wherein like numerals refer to like parts throughout, and in which.

Figure 1:
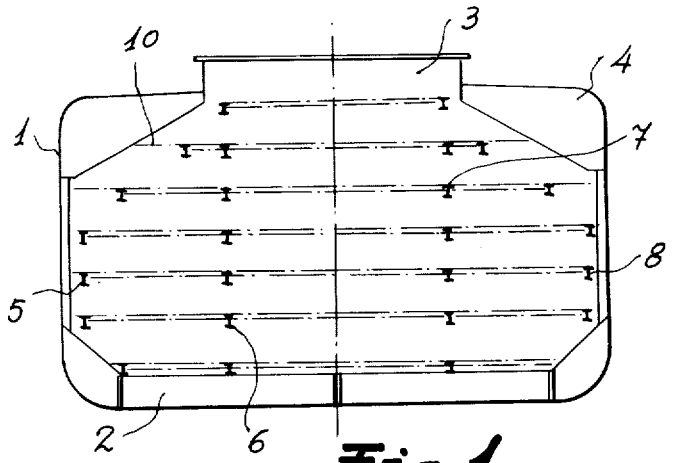
FIG. 1 is a transverse cross-sectional view of the hold of a cargo vessel fitted with the shifting tween deck structure of this invention as viewed looking toward the stern of the vessel and showing the tween decks in a position for the transport of general cargo.
Figure 4:
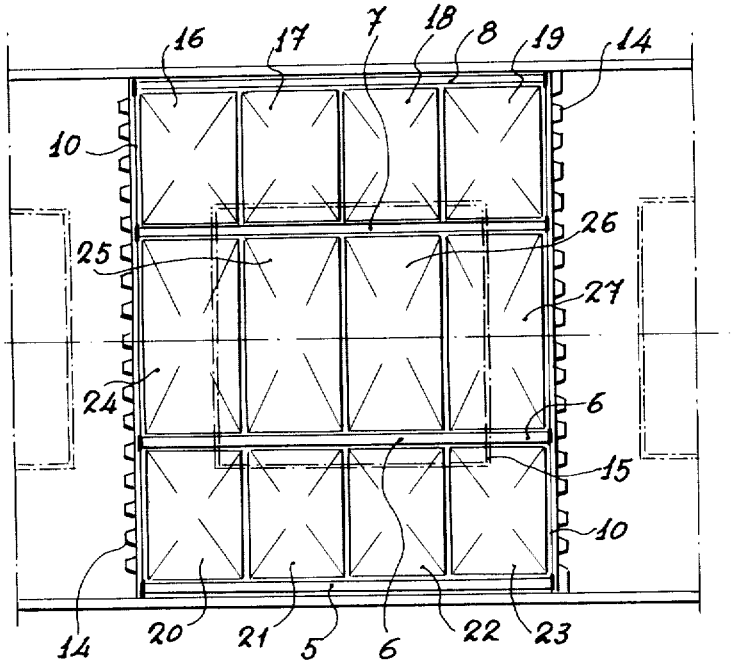
FIG. 4 is a horizontal cross-sectional view of the hold of a cargo vessel loaded with general cargo placed on omnipallets.

Referring now to the drawings, the numeral 1 represents a ship's hull such as the hull of a cargo vessel, provided in conventional manner with a double bottom 2, a hatch opening 3 through which cargo is loaded and unloaded, upper ballast tanks 4, and watertight transverse corrugated bulkheads 14 dividing the hull into a plurality of cargo holds. In the embodiment illustrated in FIGS. 1 through 4, each tween deck is comprised of four movable beams or girders, including starboard movable beam 5, central movable beams 6 and 7, and port movable beam 8. The beams 5, 6, 7 and 8 of each tween deck structure are movably supported on a pair of transverse rails 10 secured at the same vertical level at opposite ends of the cargo hold to form a track upon which the beams move. In the embodiment illustrated in FIGS. 1 through 4, rails 10 are adjacent to watertight corrugated bulkheads 14 and are oriented transverse to hull 1, i.e., the rails 10 extend across the beam of the vessel and the beams 5, 6, 7 and 8 extend longitudinally of the vessel so as to span the hold. In the illustrated embodiment, each tween deck is comprised of four movable beams excepting for the top tier which is comprised of only two beams 11 and 12. However, it is to be recognized that the tween decks can be formed of any number of beams as required to provide support for the desired number of rows of omnipallets.

Figure 2:
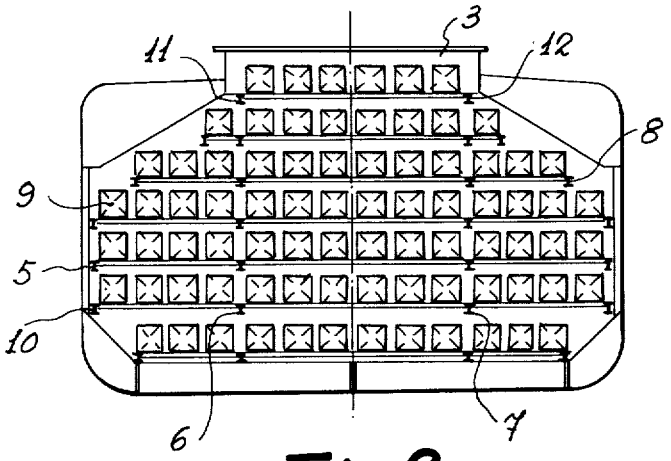
FIG. 2 is a transverse cross-sectional view of the hold of a cargo vessel fitted with the shifting tween decks structure of this invention as viewed looking toward the stern of the vessel and shown loaded with general cargo.
Figure 3:
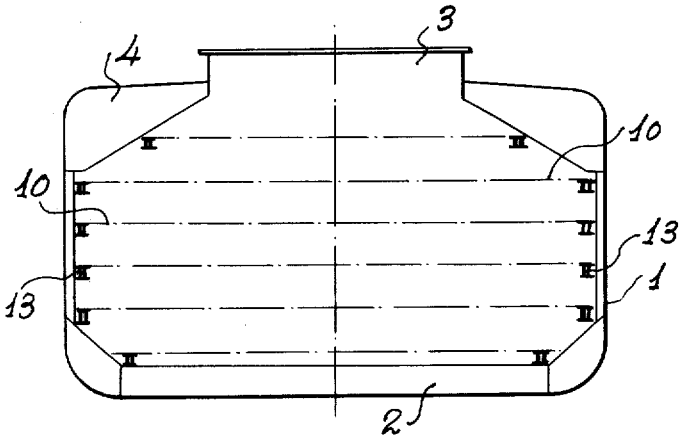
FIG. 3 is a transverse cross-sectional view of the hold of a cargo vessel fitted with the shifting tween deck structure of this invention as viewed looking toward the stern of the vessel and shown arranged for the transport of dry bulk cargo.
Figure 5:
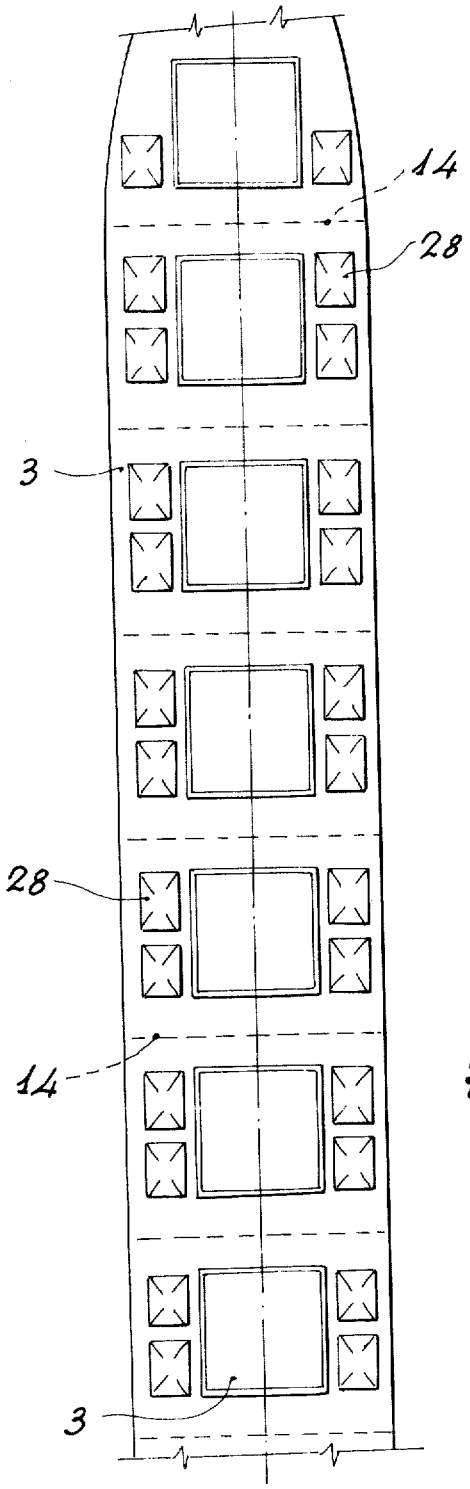
FIG. 5 is a plan view of the weatherdeck of a cargo vessel showing the stowing position of the omnipallets when the cargo hold is arranged for a dry bulk cargo.

FIG. 1 illustrates the position of the beams when arranged in the loaded position, i.e., the beams are in a position to support the omnipallets. FIG. 2 illustrates the tween decks structure supporting a cargo 9 such as a light cargo or a cargo of cars. In FIG. 3, the beams 5 and 6 of each tween decks are shifted to the starboard side of the hold and the beams 6 and 7 are shifted to the port side illustrated by the positions 13. In this manner, the tween decks can be shifted to positions at the sides of the hold to convert the hold for bulk cargo storage, with the entire cargo hold being substantially unobstructed. With the hold thus converted for the transport of dry bulk cargoes, the omnipallets can be conveniently stored on the weatherdeck in positions 28 illustrated in FIG. 5.

Figure 6:
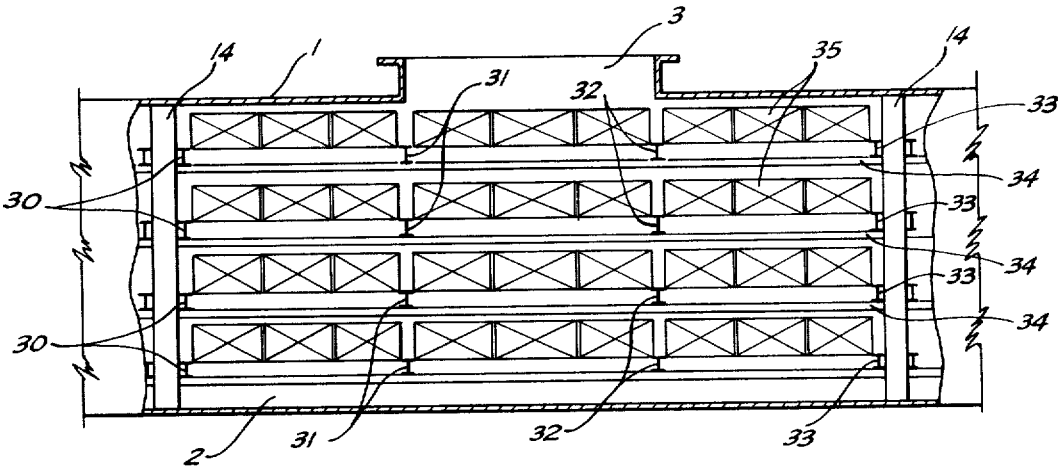
FIG. 6 is a longitudinal cross-sectional view of the hold of a cargo vessel fitted with another embodiment of the shifting tween decks structure of this invention employing beams placed transversely of the vessel and shown loaded with general cargo.

In the embodiment of the invention illustrated in FIG. 6, each tween deck is comprised of four movable beams, including aft beam 30, central beams 31 and 32, and forward beam 33, The beams 30, 31, 32 and 33 are movably supported on a pair of transverse rails 34 secured at the same vertical level at the opposite sides of the cargo hold to form a track upon which the beams move. In this embodiment, rails 34 are positioned adjacent to the sides of the hold and extend longitudinally of the hold. The beams 30, 31, 32 and 33 are positioned across the beam of the vessel so as to span the hold. The beams are movable on the rails in a longitudinal direction, i.e., the beams are movable toward the bow and stern of the vessel. The omnipallets loaded with cargo 35 are placed between adjacent beams such as the pairs of beams 30 and 31, and 32 and 33. Omnipallets are also placed in the central section between beams 31 and 32.

Figure 7:
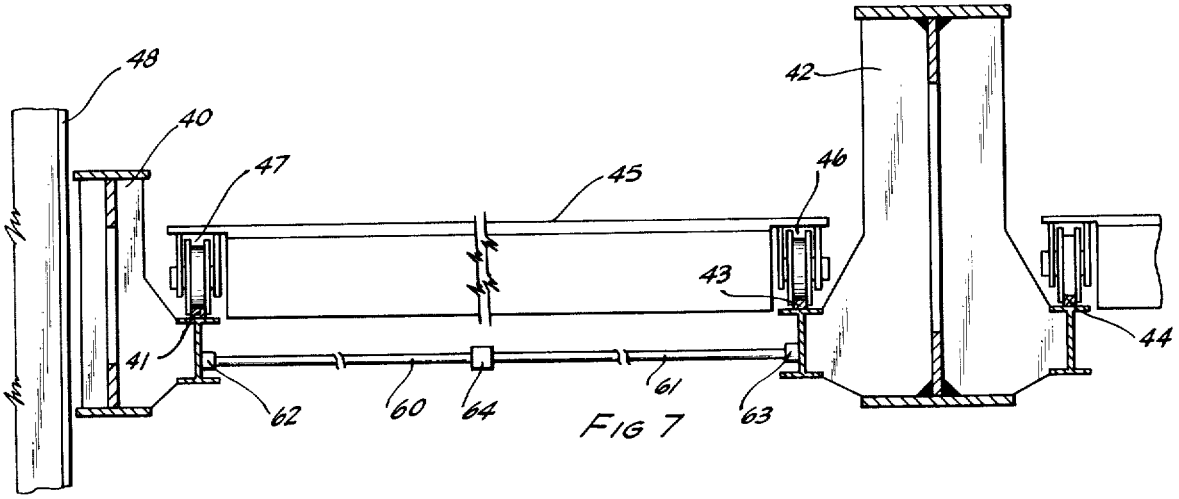
FIG. 7 is a partial cross-sectional view of the tween decks structure showing the placement of the omnipallets between adjacent beams.

The construction of the tween deck and the method of supporting the omnipallets between adjacent beams is illustrated in FIG. 7. The illustrated portion of the tween deck includes outside beam 40, provided with track 41 and interior beam 42 provided with a pair of tracks 43 and 44. Omnipallet 45 is provided with a pair of wheels on each side, such as the wheels 46 and 47. Omnipallet 45 is movable along the beams and the beams 40 and 42 are movable in a direction normal to their length, limited only by the vertical member 48 which represents a vertical frame member either at the side of the hold or adjacent to the transverse bulkhead. The beams 40 and 42 can extend longitudinally of the vessel or transversely across the hold as hereinabove more particularly described. Each adjacent pair of movable beams, such as the beams 40 and 42, are provided with means to provide the spacing required to receive the omnipallet. In the embodiment illustrated in FIG. 7, spacing is provided by rods 60 and 61 which are attached to beams 40 and 42, respectively, by hinged connectors 62 and 63, and the abutting rods are connected at their abutting ends by hinged connector 64. The rods 60 and 61 fold in the horizontal plane so that the beams may be moved into a juxtapositioned relationship, but which limit the separation between the beams. Thus, the beams are individually movable up to the limit of travel provided by the spacing rods.

Figure 9:
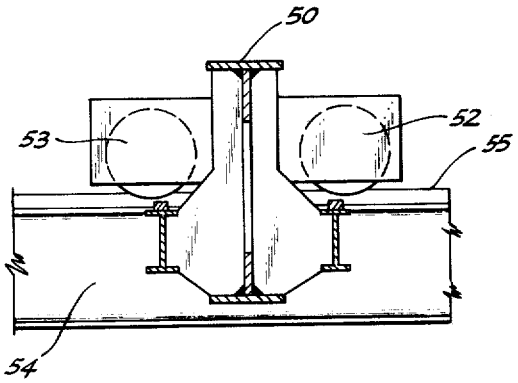
FIG. 9 is a cross-sectional view taken along the line 9—9 of FIG. 8 showing the wheel carriage adapted to travel on the horizontal rail.
Figure 8:
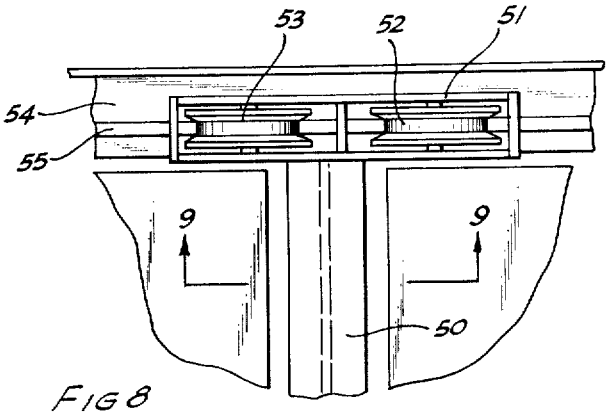
FIG. 8 is a plan view of the end portion of one of the beams showing the wheel carriage.

FIGS. 8 and 9 illustrate the mounting of the movable beams on the horizontal rails. Beam 50 represents any one of the movable beams forming the tween deck structure, and is provided with a wheel unit at each end, such as the wheel carriage 51 provided with a pair of wheels 52 and 53. Carriage 51 supporting beam 50 travels on horizontal rail 54 provided with track 55.

Figure 10:
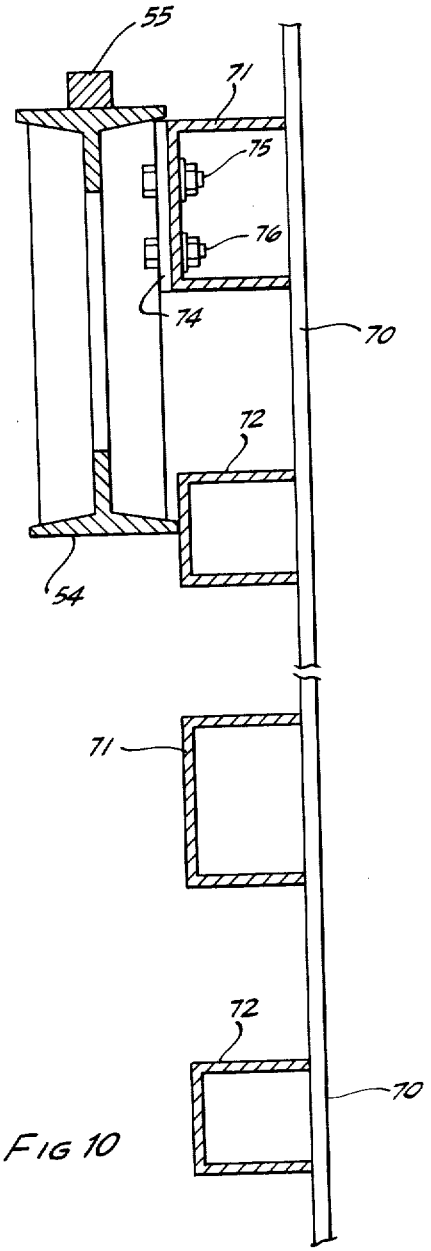
FIG. 10 is a side view partially in cross-section showing the mechanism for adjustably supporting the rails.

The horizontal rails which support the movable beams are preferably vertically adjustable so that the spacing between the various tween decks can be adjusted to efficiently accommodate cargoes of different heights, thereby permitting maximum utilization of the cargo space. Although various adjusting mechanisms can be employed, such as ratchet and pawl drives, hydraulic jacks, and the like, it is convenient in many installations to provide means for bolting the beams to the vertical support members at different vertically spaced positions. In FIG. 10, horizontal rail 54 is bolted to vertical support member 70, which can be a part of the ship's longitudinal framework or the transverse bulkhead frame. A pair of spacers 71 and 72 are welded or otherwise secured to member 70, and the beam is provided with a plate 74 which abutts spacer 71. The beam is removably secured to spacer 71 by the bolts 75 and 76. It is apparent that the beams can be readily moved to any one of a plurality of the spacers to adjust the height of the tween decks.

To facilitate rapid loading of the vessel, the cargo, such as a mixed general cargo or cars, is loaded on omnipallets placed on the quay, then duly secured to the omnipallets and left until the vessel is ready for loading. To load the omnipallets onto the vessel, an outer beam and a central beam, such as the beams 5 and 6, are shifted toward the center of the vessel so as to be positioned below hatch 3 and spaced the proper distance apart to receive the omnipallets. With the cargo jib, aft starboard omnipallet 20 is placed inside the hold and positioned so that it is supported between beams 5 and 6. Omnipallet 20 is then moved toward the aft end of the beams adjacent to the aft bulkhead 14. Then fore starboard omnipallet 23 is placed in the hold on the beams 5 and 6 and moved toward the forward end of the beam adjacent to forward bulkhead 14. Central starboard omnipallets 21 and 22 are placed on the beams 5 and 6 and the entire structure consisting of the beams 5 and 6 and omnipallets 20, 21, 22 and 23 is shifted into the storage position at the starboard side of the hold.

The same procedure is carried out in loading aft port omnipallet 16, fore port omnipallet 19, and central port omnipallets 17 and 18 onto beams 7 and 8. This entire assembly consisting of beams 7 and 8 and omnipallets 16, 17, 18 and 19 is shifted into the storage position at the port side of the vessel. With the port and starboard assemblies in the storage position, central beams 6 and 7 are at the same distance from the longitudinal axis of the ship and ready to receive the central omnipallets.

Central aft omnipallet 24 is placed so as to be supported between beams 6 and 7, and then moved toward the aft end of the beam adjacent to aft bulkhead 14. Next, central fore omnipallet 27 is placed onto beams 6 and 7, and shifted toward the forward end of the beams adjacent to forward bulkhead 14. Central omnipallets 25 and 26 are then placed on beams 6 and 7 to to complete the loading of the tween deck.

It is apparent that omnipallets 17, 18, 21, 22, 25 and 26 do not require wheels as it is not necessary to shift these omnipallets on the beams.

Loading of each successively higher tier of tween decks is completed in similar manner. Omnipallets are loaded into the trunk of hatch 3 supported beams 11 and 12. It is not necessary to shift these omnipallets on the supporting beams during the loading operation, and hence it is not necessary that these omnipallets be equipped with wheels.

A cargo hold provided with the tween deck structure of this invention and loaded with cargo on omnipallets is unloaded by reversing the above described procedure.

The loading of omnipallets of cargo into a hold equipped with the embodiment of tween decks illustrated in FIG. 6, and the subsequent unloading of such cargo, is carried out in accordance with the above described procedure excepting that the omnipallets are shifted on the beams transversely of the vessel toward the port or starboard side, and the beams are shifted longitudinally of the vessel toward the fore or aft bulkhead.

While various embodiments of the invention have been described, it will be obvious to those skilled in the art that it is not so limited, but is susceptible of various changes and modifications, which are considered within the spirit and scope of the invention as defined in the following claims.

Having now described our invention, we claim:

1. A cargo vessel adapted to haul either bulk cargo or general cargo loaded on omnipallets, which comprises:

a cargo hold formed by the vessel's hull and by bulkheads placed transversely of said hull, said cargo hold having a hatch through which cargo is loaded and discharged:

a plurality of pairs of horizontal rails, the members of each pair of rails being secured at the same vertical level at opposite sides of said cargo hold and said pairs of rails being secured in vertically spaced relationship;

a plurality of parallel beams movably supported between said pairs of rails so as to span said cargo hold, means movably supporting said plurality of parallel beams for permitting said beams to be individually movable on said rails and movable into a position below said hatch to receive cargo loaded on omnipallets and then horizontally movable into a storage position, and said means further permitting said beams to be optionally movable to positions at the sides of said cargo hold to convert the hold for bulk storage; and a plurality of omnipallets to carry said cargo, said omnipallets being positionable on a pair of said beams so as to be supported between said beams, at least some of said omnipallets being movable along said beams in a direction normal to the direction of movement of said beams.

2. The apparatus defined in claim 1 wherein said pairs of rails are positioned longitudinally of said vessel and said beams are placed transversely of said vessel.

3. The apparatus defined in claim 1 wherein said pairs of rails are positioned transversely of said vessel and said beams are placed longitudinally of said vessel.

4. The apparatus defined in claim 1 including means to adjust the vertical spacing between adjacent pairs of rails.

5. The apparatus defined in claim 1 wherein four of said beams are movably mounted on each pair of rails.

6. The apparatus defined in claim 1 wherein wheel assemblies are mounted at each end of said beams to movably support said beams between said rails.

7. The apparatus defined in claim 1 including at least two wheels mounted at each side of said movable omnipallets to movably support said omnipallets between said beams.

8. A cargo vessel adapted to haul either bulk cargo or general cargo loaded on omnipallets, which comprises:

a cargo hold formed by the vessel's hull and by bulkheads placed transversely of said hull, said cargo hold having a hatch through which cargo is loaded and discharged;

a plurality of pairs of horizontal rails positioned longitudinally of said hull, the members of each pair being adjustably secured at the same vertical level at opposite sides of said cargo hold so that the vertical spacing between adjacent pairs of rails can be varied;

a plurality of parallel beams positioned transverse of said hull and supported between said pairs of rails so as to span said cargo hold, said beams having wheel assemblies mounted at each end of said beams to movably support said beams between said pairs of rails for permitting said beams to be individually movable on said rails in a direction longitudinal of said hull and movable into a position below said hatch to receive cargo loaded on omnipallets and then movable horizontally into a storage position, said beams thus being optionally movable to positions at the sides of said cargo hold adjacent to said bulkheads to convert the hold for bulk storage; and a plurality of omnipallets to carry said cargo positionable on a pair of said beams so as to be supported between said beams, at least some of said omnipallets having at least two wheels mounted at each side thereof to movably support said omnipallets between said beams whereby said omnipallets are movable along said beams in a direction normal to the direction of movement of said beams.

9. The apparatus defined in claim 8 wherein four of said beams are movably mounted on each pair of rails.

10. A cargo vessel adapted to haul either bulk cargo or general cargo loaded on omnipallets, which comprises:

a cargo hold formed by the vessel's hull and by bulkheads placed transversely of said hull, said cargo hold having a hatch through which cargo is loaded and discharged;

a plurality of pairs of horizontal rails positioned transversely of said hull, the members of each pair being adjustably secured at the same vertical level at opposite sides of said cargo hold so that the vertical spacing between adjacent pairs of rails can be varied;

a plurality of parallel beams positioned longitudinally of said hull and supported between said pairs of rails so as to span said cargo hold, said beams having wheel assemblies mounted at each end of said beams to movably support said beams between said pairs of rails for permitting said beams to be individually movable on said rails in a direction transverse to said hull and movable into a position below said hatch to receive cargo loaded on omnipallets and then movable horizontally into a storage position, said beams thus being optionally movable to positions at the sides of said hull to convert the hull for bulk storage; and a plurallity of omnipallets to carry said cargo positionable on a pair of said beams so as to be supported between said beams, at least some of said omnipallets having at least two wheels mounted at each side thereof to movably support said omnipallets between said beams whereby said omnipallets are movable along said beams in a direction normal to the direction of movement of said beams.

11. The apparatus defined in claim 10 wherein four of said beams are movably mounted on each pair of rails.

12. A method for loading cargo into a ship's hold which comprises:

1. placing an omnipallet of cargo on a pair of individually movable supporting beams in said ship's hold below a cargo hatch and thereafter shifting said omnipallet to one end of said beams;
2. placing a second omnipallet of cargo on said pair of supporting beams and shifting said omnipallet to the opposite end of said beams;
3. placing additional omnipallets of cargo in intermediate positions on said beam;
4. shifting said pair of beams supporting said omnipallets to one extreme side of said cargo hold;
5. repeating steps (1), (2), and (3) to place additional omnipallets on a second pair of beams positioned below said cargo hatch and shifting said second pair of individually movable beams supporting said omnipallets of cargo to the opposite side of said hold.

6. placing an omnipallaet of cargo in a central position on the innermost beams of each of said first and second pairs of beams toward the central portion of said hold and shifting said omnipallet to one end of said beams;
7. placing a second omnipallet of cargo in a central position on said innermost beams and shifting said omnipallets to the opposite end of said beams; and
8. placing additional omnipallets of cargo in intermediate positions on said innermost beams.

13. The method defined in claim 12 including repeating steps (1) to (8) to load a plurality of tiers of cargo.

14. The method defined in claim 12 including the step of unloading said omnipallets of cargo, and thereafter shifting said beams to a position adjacent to the sides of said hold to convert said hold for the loading of a bulk cargo.

* * * * *